United States Patent [19]

Potochnik

[11] 4,249,486

[45] Feb. 10, 1981

[54] STEAM CONDENSATE AND WASTE WATER RECYCLING PROCESS

[75] Inventor: Frank S. Potochnik, Scotia, N.Y.

[73] Assignee: General Electric Company, Waterford, N.Y.

[21] Appl. No.: 68,373

[22] Filed: Aug. 21, 1979

[51] Int. Cl.[3] ..... F22D 5/26

[52] U.S. Cl. ..... 122/451 R; 122/412

[58] Field of Search ..... 122/451, 412, 451.2; 203/21

[56] References Cited

U.S. PATENT DOCUMENTS

| | | | |
|---|---|---|---|
| 1,006,038 | 10/1911 | Wyllie | 122/451 |
| 3,116,876 | 1/1964 | Palm | 122/451 R |

*Primary Examiner*—Frank Sever

*Attorney, Agent, or Firm*—John L. Young; Michael J. Doyle; E. Philip Koltos

[57] ABSTRACT

Condensate released from traps on a chemical distillation reboiler is piped to a flash tank where steam is flashed off as condensate pressure is reduced. The steam is recondensed by contact with water obtained from heat exchangers and the condensate-water mixture collects in the flash tank where it may be pumped to a mixing tank remotely located at a steam boiler water purification plant. At the mix tank, excess condensate water mixture is released into a sewer or fresh make-up river water is added as required to satisfy boiler water needs. Mix ratio is controlled by mix tank pressure and in normal operation this stream provides 100% of the boiler feed water requirements.

7 Claims, 1 Drawing Figure

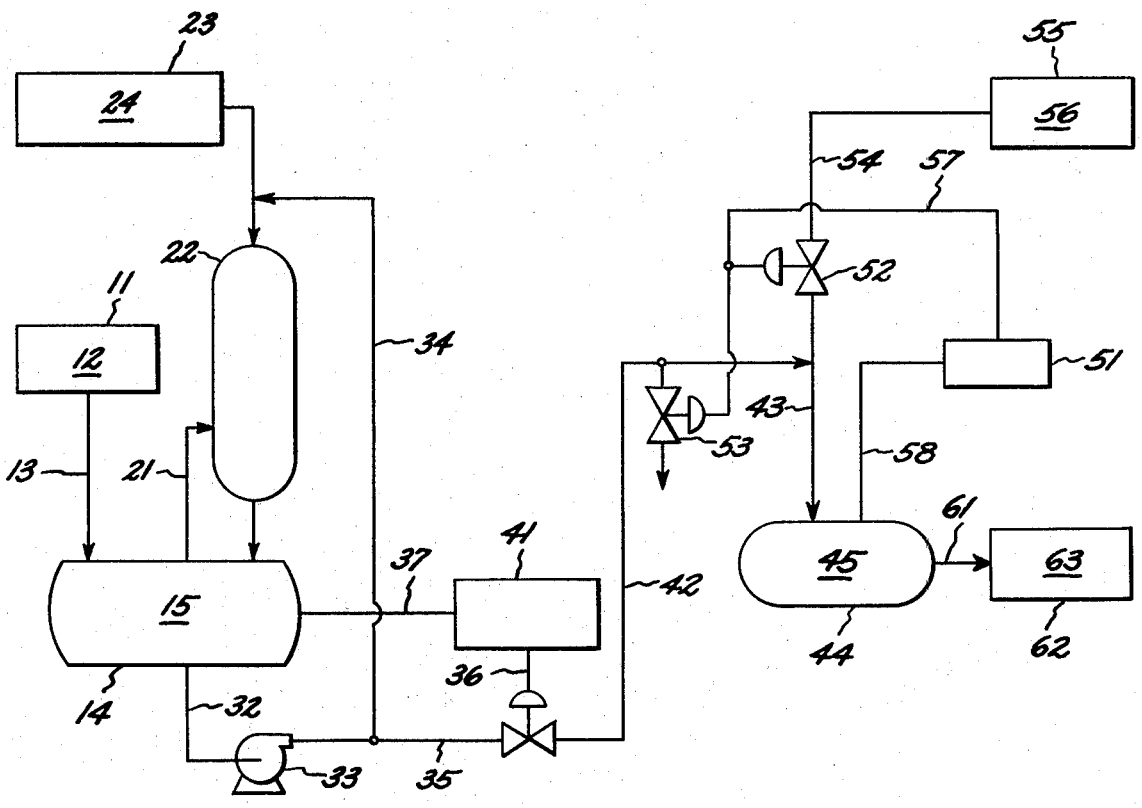
23
24
22
11
12
13
21
15
14
32
33
34
35
36
37
41
42
43
44
45
51
52
53
54
55
56
57
58
61
62
63

STEAM CONDENSATE AND WASTE WATER RECYCLING PROCESS

BACKGROUND OF THE INVENTION

The present invention relates to a process for recovering waste heat which is particularly effective for recovering the heat lost in condenser water, condensate and flash steam from heat exchangers in a chemical distillation or other manufacturing process. All condensate from steam heated reboilers and all warm water from water cooled condensers, which would ordinarily be discharged to storm sewers, may be recycled through the process of the present invention to recover waste heat contained therein.

While steam recycling systems are not unknown, as for example, in steam engines and other waste heat recovery processes, the present invention provides an industrial scale waste heat recovery process offering remarkable efficiency and reduction in expense, wherein great quantities of ordinarily exhausted waste heat can be recovered economically and transmitted across an industrial site for reprocessing.

Chemical processes often utilize pressurized steam to aid in carrying out reactions, processes and distillations. Often, this steam is produced in a steam or power plant which is remotely located from the site of the chemical process since it may have to serve the needs of an entire manufacturing facility. Pressurized steam or hot water can be pumped to the process site and utilized, but expanded steam is ordinarily discharged as a waste product of the process.

With the condensate recovery system of the present invention, condensate from chemical distillation reboilers and warm water condensers can be collected while still hot and recycled to a steam plant where it may become the major source of boiler water depending upon the requirements of the steam plant.

If in a chemical process, pressurized steam is passed through a reaction mixture for intimate mixing, agitating, heating and pressurizing purposes, it is necessary that the boiler feed water at the steam generating plant be purified before it is converted to steam. For example, if the source of the boiler feed is river water it may contain unacceptable amounts of air, carbon dioxide and living or dead organic matter for a particular chemical process. Since the present invention recycles a significant amount of the hot pressurized steam condensate utilized in the chemical process, not only is there a substantial energy savings but additionally, the necessity and expense of purifying large amounts of boiler feed water can be dramatically reduced.

Operation of the present invention offers substantial benefits to those interested in increased energy efficiency. Recycling steam in the manner disclosed by the present invention serves to reduce the fuel consumption requirements of the boiler plant which produces the steam. Furthermore, not only is thermal pollution reduced in terms of pounds of steam released per hour, but also, damage to storm sewers where the steam would ordinarily be released is eliminated. Additionally, storm sewer and secondary water supply loading can be substantially decreased.

It is therefore an object of the present invention to provide a process for the efficient recovery of waste heat from a manufacturing process.

It is another object of the present invention to provide for recycling steam condensate in a distillation or manufacturing process.

It is another object to provide a process for supplying substantially pre-purified and pre-heated boiler feed water requirements.

These and other objects will become apparent upon careful consideration of the following specification taken in conjunction with the accompanying drawing.

SUMMARY OF THE INVENTION

The present invention is directed toward a process for recovering waste heat and more particularly in the recycling of hot pressurized steam condensate in a chemical distillation process. Hot pressurized steam condensate is directed from the heat exchangers or reboilers of a distillation system to a flash tank maintained at a pressure less than that of the condensate. Ordinarily, the tank will be maintained at atmospheric pressure. When the pressurized steam condensate enters the unpressurized environment of the flash tank there is a tendency for a portion of the condensate to convert to steam. This steam can be condensed in a flash condenser and the heat contained in this steam can be recovered by running waste water through the flash condenser where it will intimately mix with the condensing steam and thus retain its heat value in the mixture. The condensate-water mixture is then returned to the flash tank. For greater efficiency, hot waste water obtained from heat exchangers associated with the manufacturing or distillation process may be utilized.

Automatic or programmable level control means may be utilized to maintain the level within the flash tank in order to more efficiently supply the requirements of a boiler water purification system or other boiler feed supply. Although the condensate-water mixture in the flash tank can be directed to the mix tank with a pressure pot or blow tank arrangement, it is more advantageous to utilize a pump system wherein the contents of the flash tank are drawn off and urged under pressure to the mix tank, which may be located remotely from the flash tank. Since a boiler feed system is maintained under pressure, utilization of a pump system in the present invention eliminates the need for repressurizing the condensate-water mixture when it arrives at the boiler house mix tank. For greater efficiency, a portion of the condensate-waste water mixture can be recycled through the flash condenser to insure greater contact and mixing between the condensate and waste water. If the quantity of the condensate-waste water mixture is greater than the requirements of the boiler water purification system any excess can be dumped through a release valve. On the other hand, if the condensate-waste water recycling system is insufficient to provide for the boiler water system requirements, make-up water from a secondary source such as a river can be added automatically through programmable pressure controls.

DESCRIPTION OF THE PREFERRED EMBODIMENT

The accompanying drawing represents a diagrammatic plan of a process for recovery of waste heat in a condensate-waste water recycling system.

Box 11 in the drawing represents a source of hot pressurized steam condensate 12. The steam condensate is directed is directed through conduit 13 to a flash tank 14, which is located proximately to the source of the hot pressurized steam condensate and remotely from a steam boiler water plant where such hot pressurized steam condensate will be recycled. The flash tank is maintained at a pressure less than the pressure of the steam condensate in conduit 13 and will ordinarily be maintained at atmospheric pressure and ambient temperatures.

When the hot pressurized steam condensate enters the unpressurized flash tank there is a tendency for a portion of the condensate to convert to steam. The rate of conversion is determined by the equilibrium temperature of the condensate and the tank as well as the pressure of the condensate. This steam is vented through conduit 21 to a flash condenser 22, which recondenses the vented steam. Ordinarily, about approximately 0–15% of the hot pressurized steam condensate will be vented to the flash condenser.

The heat value contained in the vented, recondensed steam can be captured by running waste water 24 through the flash condenser where it will intimately mix with the recondensed steam and fall back into flash tank 14. Box 23 in the diagram represents the many sources of waste water, which may be utilized by the present invention including hot waste water from a heat exchanger in a manufacturing or chemical distillation process. Any source of water 23 may be used, such as river water or pre-purified boiler water, however, utilization of hot waste water obtains the advantage of increasing the energy saving efficiency of the overall process.

After the hot waste water-condensate mixture returns to flash tank 14, the contents 15 of the flash tank will be a hot unpressurized liquid. This hot, unpressurized liquid in flash tank 14 may be directed to a boiler water purification system from a remote location by drawing the liquid through conduit 32 to pump 33 where it is urged under pressure through conduit 35 for deposit into a pressurized boiler water plant system.

A portion of the hot condensate-water mixture in conduit 35 may be recycled to the flash condenser 22 via conduit 34 to improve the efficiency of the process by assuring better contact of liquid with the vented, recondensed steam.

Box 41 in the drawing represents means for controlling the level maintained within the flash tank. A guage or other suitable level indicator will sense the level maintained in the flash tank and convey this information along route 37 to the control means 41, which is effective for regulating the flow through adjustable valve 36. The regulated flow continues through conduit 42 towards conduit 43 and ultimately to mix tank 44. The contents 45 of mix tank 44 serve to meet the requirements 63 of a steam boiler water system represented by box 62. In normal operation, 100% of the requirements of the system can be met through the operation of the steam condensate-water recycling system of the present invention. When an insufficient amount of the steam condensate-water mixture is recycled into the mix tank 44 to meet the requirements of the steam boiler system, make-up water 56 from a secondary souce represented by box 55, can be added through conduit 54 to conduit 43, which leads to mix tank 44. Pressure control means represented in the diagram by box 51 can be provided which will sense the quantity of liquid in mix tank 45 and control the various rates of flow automatically. For example, when the flow of the unpressurized condensate-water mixture in conduit 42 is in excess of the capacity of mix tank 44, control means 51 may be utilized to discharge the excess flow through valve 53. On the other hand, when the flow of the steam condensate-water mixture is insufficient to meet the requirements of the boiler water system, valve 52 can be automatically opened to allow an additional amount of the secondary water supply to be directed to mix tank 44.

Pressure control 51 is effective for monitoring the condensate-waste water mixture under pressure for further processing by a steam boiler water purification system when purified steam is required for the subject manufacturing process.

The flash tank utilized in one embodiment of the present invention was 16 feet in length and had a 5'6" diameter and a design pressure of 79 psig with a full vacuum rating at 275° F. This tank had a capacity of 3,165 gallons. The flash condenser was of the direct-contact type and was 18 ft. high, having a 4 ft. inside diameter and a design pressure of 107 psig with a full vacuum rating at 275° F. This condenser was equipped with six sieve trays of 14 guage 304 SS, wherein the three bottom trays had 727 holes, each hole being 0.5 inches and a total of 2.803 sq. ft. per tray; and the top three trays had 114 holes at 0.5 in. per hole and a total of 1.596 sq. ft. each. The design liquid depth of the condenser is 5.0 in. for a liquid having a specific gravity of 1.0. This mix tank was 15 ft. in length and had a 6 ft. outside diameter and a design pressure of 150 psig with a full vacuum rating at 275° F. The mix tank had a capacity of 4,538 gallons. The main transfer pipe, which is designed to direct the condensate from a flash tank, which is remotely located from the mix tank, is traced and insulated and in the present embodiment is approximately 2,000 ft. in length. Tracing is provided to protect against freeze up in the event of a winter time maintenance shutdown. A level controller maintains the liquid level in the flash tank by operating a control valve which allows condensate to be pumped under pressure from the flash tank to the mix tank in the boiler house area. As more condensate and water accumulate in the flash tank, the level control 41 will open to increase flow and maintain liquid level. If accumulation in the tank drops off, level control 41 will throttle down valve 36 to reduce flow. The system is designed so that all water to the boiler house filter system passes through the mix tank and so ordinarily 100% of the boiler water purification system requirements can be met by the recycled condensate. If the condensate recovery system is shutdown, all water to the boiler house still passes through the mix tank and the adjustable flow regulator 52, as depicted on the accompanying drawing, can be utilized to supply sufficient water from a secondary source, such as a nearby river.

When the condensate recovery system is out of operation for maintenance, the reboiler condensate can be diverted to a sewer quench system. A sewer quench mixes condensate with water as it is discharged to the sewer to prevent damage to sewer lines and steam flash in the area.

The following table depicts typical ranges for the critical process variables as well as typical observed values for these parameters. In the notes following the table, the numerals refer back to the drawing accompanying this specification.

TABLE 1

| Process Variables | Parts/Hour Typical | Parts/Hour Range | Temperature (°F.) Typical | Temperature (°F.) Range | Pressure(PSIG) Typical | Pressure(PSIG) Range |
|---|---|---|---|---|---|---|
| I | 27 | 0–100 | 357 | 212–365 (c) | 133 | 0–150 (c) |
| II | 56 | 0–100 | 120 | 32–212 (c) | 40 | 0 (c) |
| III | 4 | 0–15 | 216 | 212–365 | 15 | 0 (c) |
| IV | 8 | 0–100 | 199 | 32–349 (b) | 119 | 0 (c) |
| V | 83 | 0–100 | 199 | 32–349 (b) | 119 | 0 (c) |
| VI | 0 | 0–100 | — | — | — | — |
| VII | 17 | 0–100 | 50 | Ambient | 75 | Greater than VIII |
| VIII | 100 | 0–100 | 199 | 32–315 (b) | 70 | (a) |

NOTES
(a) limited by steam boiler water requirements
(b) limited by pressure at this point
(c) no upper limit within equipment capabilities I. Hot pressurized steam condensate as measured from conduit 13

II. Hot waste water from a heat exchanger as measured from source 23

III. Vented steam from the flash tank as measured in conduit 21

IV. Recycled condensate-water mixture for greater efficiency as measured in conduit 34

V. Condensate-water mixture directed from flash tank to mix tank as measured in conduit 42

VI. Overflow from condensate-water mixture in excess of system capacity as measured at control valve 53

VII. Secondary source of water 56 as measured in conduit 54

VIII. Steam boiler water purification system requirements

It is to be noted that in normal operation, not only does the process of the present invention provide 100% of the requirements of a steam boiler water purification system, but also, recycled condensate has already been pre-purified and only the added waste water need be treated. And furthermore, since both the steam condensate and the added waste water have already been heated, substantially less heat is required at the power plant to reconvert the condensate-water mixture to steam. Additionally, it has been found that little more than approximately 0–5% of the thermal valve of the condensate-water mixture is lost despite the fact that the mixture may be conducted across an industrial site between the source of the steam and the source of the steam condensate.

What is claimed as new and desired to be protected by Letters Patent of the United States is:

1. A process for recovering waste heat, comprising the steps of: (a) substantially closed heating system of a directing pre-purified hot pressurized steam condensate from a distillation process located remotely from said process for recovering waste heat, to a flash tank maintained at a pressure less than that of said condensate;

(b) flashing said condensate to an extent determined by the equilibrium temperature of said flash tank and the pressure of said condensate;

(c) venting any resulting expanded steam from said flash tank to a condenser;

(d) condensing said expanded steam and simultaneously mixing said expanded steam with an amount of hot waste water obtained from a heat exchanger utilized in said distillation process and returning a condensate-water mixture to said flash tank; and (e) pumping the contents of said flash tank in excess of a predetermined level from a remote location to a steam boiler water system mix tank; wherein substantial amounts of said condensate are recovered, so as to minimize the water make-up requirements of said heating system.

2. A process as in claim 1, further comprising the step of: controlling the level of said flash tank at a predetermined level.

3. A process as in claim 1, further comprising the step of: controlling the pressure of said boiler water system mix tank.

4. A process as in claim 3, further comprising the step of: adding to said mix tank an amount of make-up water effective for maintaining a predetermined level within said tank and supplying the boiler feed requirements of said boiler water system.

5. A process as in claim 1 wherein said distillation process is a methyl-chlorosilane distillation.

6. A process for recovering waste heat as in claim 1, comprising the steps of:

(a) directing from 1 to 100 parts per hour of a hot pressurized steam condensate having a temperature of, approximately, 212° to 365° F. and a pressure of, approximately, 1 to 150 psig to a flash tank maintained at approximately atmospheric pressure;

(b) flashing said condensate to an extent determined by the equilibrium temperature of said flash tank and the pressure of said condensate;

(c) venting from 1 to 15 parts per hour of any resulting expanded steam having a temperature of, approximately, 212°–365° F. to a flash condenser;

(d) condensing said expanded steam and simultaneously mixing said expanded steam with approximately 0 to 100 parts waste water having a temperature of, approximately, 32° to 212° F. and returning a condensate-water mixture to said flash tank;

(e) recycling from 0 to 100 parts per hours of said condensate water mixture having a temperature of, approximately, 32° to 340° F. to said flash condenser; and (f) pumping from 1 to 100 parts per hour of said condensate-water mixture having a temperature of, approximately, 32° to 349° F. to a remotely located steam boiler water mix tank.

7. A process as in claim 6, further comprising the step of supplying 1 to 100 parts per hour of a pre-purified and pre-heated condensate-water mixture having a temperature of, approximately, 32° to 315° F. to a steam boiler water purification system.

* * * * *

UNITED STATES PATENT AND TRADEMARK OFFICE

CERTIFICATE OF CORRECTION

PATENT NO. : 4,249,486

DATED : February 10, 1981

INVENTOR(S) : Potochnik

It is certified that error appears in the above-identified patent and that said Letters Patent are hereby corrected as shown below:

In col. 5, line 51, after "(a)", delete the following: "substantially closed heating system of a".

In col. 5, line 53, after "a" insert the following: -- substantially closed heating system of a --.

Signed and Sealed this

*Twenty-sixth* Day of *October 1982*

[SEAL]

*Attest:*

GERALD J. MOSSINGHOFF

*Attesting Officer*

*Commissioner of Patents and Trademarks*